US009661412B2

(12) United States Patent
Yan et al.

(10) Patent No.: US 9,661,412 B2
(45) Date of Patent: May 23, 2017

(54) APPARATUS FOR PROVIDING PASSIVE STEREO AMPLIFICATION FOR A PORTABLE DEVICE

(75) Inventors: Qifeng Yan, Espoo (FI); Ming Lei, Shenzhen (CN); Zhichang Wang, Shenzhen (CN); Jyri Salomaa, Espoo (FI); Zhen Liu, Tarrytown, NY (US); Koray Ozcan, Farnborough (GB)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/126,314

(22) PCT Filed: Jun. 20, 2011

(86) PCT No.: PCT/CN2011/075914

§ 371 (c)(1),
(2), (4) Date: Mar. 17, 2014

(87) PCT Pub. No.: WO2012/174698

PCT Pub. Date: Dec. 27, 2012

(65) Prior Publication Data

US 2014/0193019 A1 Jul. 10, 2014

(51) Int. Cl.
*H04R 1/20* (2006.01)
*H04R 1/28* (2006.01)
(Continued)

(52) U.S. Cl.
CPC ..... *H04R 1/2861* (2013.01); *H04R 1/30* (2013.01); *H04R 1/345* (2013.01)

(58) Field of Classification Search
CPC ..... H04R 1/2861; H04R 1/28; H04R 1/2803; H04R 1/2846; H04R 1/2853;
(Continued)

(56) References Cited

U.S. PATENT DOCUMENTS

2005/0105745 A1* 5/2005 Bowen et al. ..... 381/89
2007/0101039 A1* 5/2007 Rutledge et al. ..... G06F 1/1632 710/303

(Continued)

FOREIGN PATENT DOCUMENTS

CN 2786890 6/2006
CN 1878425 12/2006

(Continued)

OTHER PUBLICATIONS

"AirCurve Play", Acoustic Amplifier for iPhone 4, Griffin Technology, Retrieved on May 1, 2014, Webpage available at: http://store.griffintechnology.com/aircurve-play.

(Continued)

*Primary Examiner* — Md S Elahee
*Assistant Examiner* — Sabrina Diaz
(74) *Attorney, Agent, or Firm* — Harrington & Smith

(57) ABSTRACT

An apparatus comprising: a first substantially horn shaped structure configured to couple and amplify sound from a first speaker of a further apparatus; and a second substantially horn shaped structure configured to couple and amplify sound from a second speaker of the further apparatus, wherein the first and second substantially horn shaped structure each comprise a mouth portion with a physical separation dimension greater than a physical separation dimension of the first and second speaker acoustic outlet of the further apparatus.

18 Claims, 6 Drawing Sheets

(51) Int. Cl.
*H04R 1/30* (2006.01)
*H04R 1/34* (2006.01)

(58) Field of Classification Search
CPC .. H04R 1/2857; H04R 1/2865; H04R 1/2884; H04R 1/2888; H04R 1/30; H04R 1/345; H04R 1/32; H04R 1/323; H04R 2201/34; H04R 2201/40; H04R 1/34; H04R 1/40; H04R 1/403; H04R 1/42; H04R 1/02; G10K 11/08; G10K 11/02; G10K 11/26
USPC ..... 381/337–342; 379/441, 454, 444; 181/175, 177, 179
See application file for complete search history.

(56) References Cited

U.S. PATENT DOCUMENTS

| | | | | |
|---|---|---|---|---|
| 2007/0223745 | A1 | 9/2007 | Feng et al. | |
| 2012/0237058 | A1* | 9/2012 | Salomaa et al. | 381/111 |

FOREIGN PATENT DOCUMENTS

| | | | | | |
|---|---|---|---|---|---|
| CN | 201804455 | U | | 4/2011 | |
| EP | 1178702 | | | 2/2002 | |
| EP | 1589729 | A2 | | 10/2005 | |
| GB | 2377116 | | * | 12/2002 | H04M 1/04 |
| JP | 2005-136895 | | * | 5/2005 | H04M 1/04 |
| WO | 2005/051037 | A1 | | 6/2005 | |
| WO | 2007/111650 | A1 | | 10/2007 | |
| WO | 2008/023167 | A1 | | 2/2008 | |
| WO | 2011/066682 | A1 | | 6/2011 | |
| WO | WO 2011/066682 | | * | 6/2011 | G10K 11/02 |

OTHER PUBLICATIONS

International Search Report and Written Opinion received for corresponding Patent Cooperation Treaty Application No. PCT/CN2011/075914 , dated Mar. 22, 2012, 13 pages.

* cited by examiner

APPARATUS FOR PROVIDING PASSIVE STEREO AMPLIFICATION FOR A PORTABLE DEVICE

RELATED APPLICATION

This application was originally filed as PCT Application No. PCT/CN2011/075914 filed Jun. 20, 2011.

FIELD OF THE APPLICATION

The present application relates to a method and apparatus. In some embodiments the method and apparatus relate to passive amplifiers and some further embodiments relate to an apparatus having a stereo speaker associated with the passive amplifiers.

BACKGROUND OF THE APPLICATION

Some portable devices comprise integrated speakers for creating sound such as playing back music or having a telephone conversation. The loudness of the integrated speakers is important especially in environments where the ambient noise levels are high, even indoors. The loudness of the integrated speakers in a portable device is important for perception of ringtones of a mobile telephone. In some countries the loudness of the integrated speakers is important for listening to radio broadcasts.

In some parts of the world a portable device with an integrated speaker may be the only device the user owns which is capable of playing music. For example, a user may only be able to play music using a loudspeaker of a mobile telephone. The loudness and quality of sound from an integrated speaker is even more important if a user is solely reliant on an integrated speaker of a portable device for music playback.

It is known to increase the loudness of integrated speakers by actively amplifying sound by electronic solutions. For example, circuitry comprising large transducers, components for signal processing and other electrical modifications have been used. Other solutions further comprise external loudspeakers. Typically digital signal processing (DSP) may increase loudness by using one or more of the following; digital gains, equalization (EQ), single or multiple dynamic range controllers (DRC) and transducer protection. It is understood that there may be more additional systems or algorithms which are designed for use in digital signal processing. For example, in addition there may be and/or other systems in a playback chain such as electrical filters.

SUMMARY OF THE APPLICATION

In a first aspect there is provided an apparatus comprising: a first substantially horn shaped structure configured to couple and amplify sound from a first speaker of a further apparatus; and a second substantially horn shaped structure configured to couple and amplify sound from a second speaker of the further apparatus, wherein the first and second substantially horn shaped structure each comprise a mouth portion with a physical separation dimension greater than a physical separation dimension of the first and second speaker acoustic outlet of the further apparatus.

The first and second substantially horn shaped structure mouth portion may have a cross sectional area greater than each of the first and second speaker acoustic outlet of the further apparatus cross sectional area.

Each of the first and second substantially horn shaped structure throat portion may have a cross sectional area which is one of: greater than each of the first and second speaker acoustic outlet of the further apparatus cross sectional area; substantially the same as each of the first and second speaker acoustic outlet of the further apparatus cross sectional area; and less than each of the first and second speaker acoustic outlet of the further apparatus cross sectional area.

Each substantially horn shaped structure may comprise at least one of: a conical horn; an exponential horn; and a tractrix horn.

Each substantially horn shaped structure may be tuneable.

The apparatus may further comprise: a first interface portion configured to seal a throat portion of the first substantially horn shaped structure to the first speaker; and a second interface portion configured to seal a throat portion of the second substantially horn shaped structure to the second speaker.

Each interface portion may further releaseably mechanically couple the further apparatus to the apparatus.

The apparatus may further comprise a locating portion configured to releaseably mechanically couple the further apparatus to the apparatus.

The apparatus may further comprise: a first part comprising at least two audio input windows; and a second part comprising at least two audio output windows, wherein the first part and the second part form a structure with two separate voids, the first void forming the first substantially horn shaped structure located between the first part first audio input window and the second part first audio output window and the second void forming the second substantially horn shaped structure defined between the first part second audio input window and the second part second audio output window.

The apparatus may further comprise an indicator.

The indicator may comprise at least one of: a plug configured to interface with the further apparatus; at least one pin configured to interface with the further apparatus; a cover portion configured to interface with the further apparatus; and a radio frequency identifier, wherein the indicator is configured to identify the apparatus to the further apparatus.

The apparatus may be made from one or more of the following: paper, cardboard, plastics material.

The first substantially horn shaped structure may be dimensionally different from the second substantially horn shaped structure.

An apparatus may comprise: a first speaker; a second speaker; and a detector configured to determine the apparatus is coupled to a further apparatus as described herein.

The detector may comprise at least one of: a light sensor configured to detect a cover portion on the further apparatus; a radio frequency identifier sensor configured to detect a radio frequency identifier on the further apparatus; a socket configured to receive a plug or pin on the further apparatus; a keypad configured to receive a plug or pin on the further apparatus; and at least one microswitch configured to receive a plug or at least one pin on the further apparatus; an electrical impedance monitor coupled to each speaker.

The apparatus may further comprise a digital signal processor configured to output an audio signal to each speaker dependent on the detector.

The digital signal processor may comprise a first speaker digital signal processor configured to output an audio signal to the first speaker dependent on the detector; and a second speaker digital signal processor configured to output a further audio signal to the second speaker dependent on the detector.

The detector may be configured to determine dimensionally different horn shaped structured and control the digital signal processor to account for the difference between the different substantially horn shaped structures.

The digital signal processor may comprise at least one of: an equalizer; an amplifier with variable gain; a volume level controller; a dynamic range controller; a bandwidth controller; a filter with a defined frequency response; a speaker/transducer protection controller; and a loudness controller.

The digital signal processor may be configured to modify the frequency response and/or loudness of the audio signal dependent on the detector.

The detector may be configured to detect the type of further apparatus coupled to the apparatus.

The detector may be a user input to the apparatus.

According to a second aspect of the application there can be provided a method comprising manufacturing an apparatus as described herein from a blank.

The method may comprise moulding a blank to provide the first and second substantially horn shaped structures.

BRIEF DESCRIPTION OF DRAWINGS

For a better understanding of the present application and as to how the same may be carried into effect, reference will now be made by way of example to the accompanying drawings in which.

DESCRIPTION OF SOME EMBODIMENTS OF THE APPLICATION

The following describes apparatus and methods for providing passive stereo amplification for a portable device.

Figure 6:
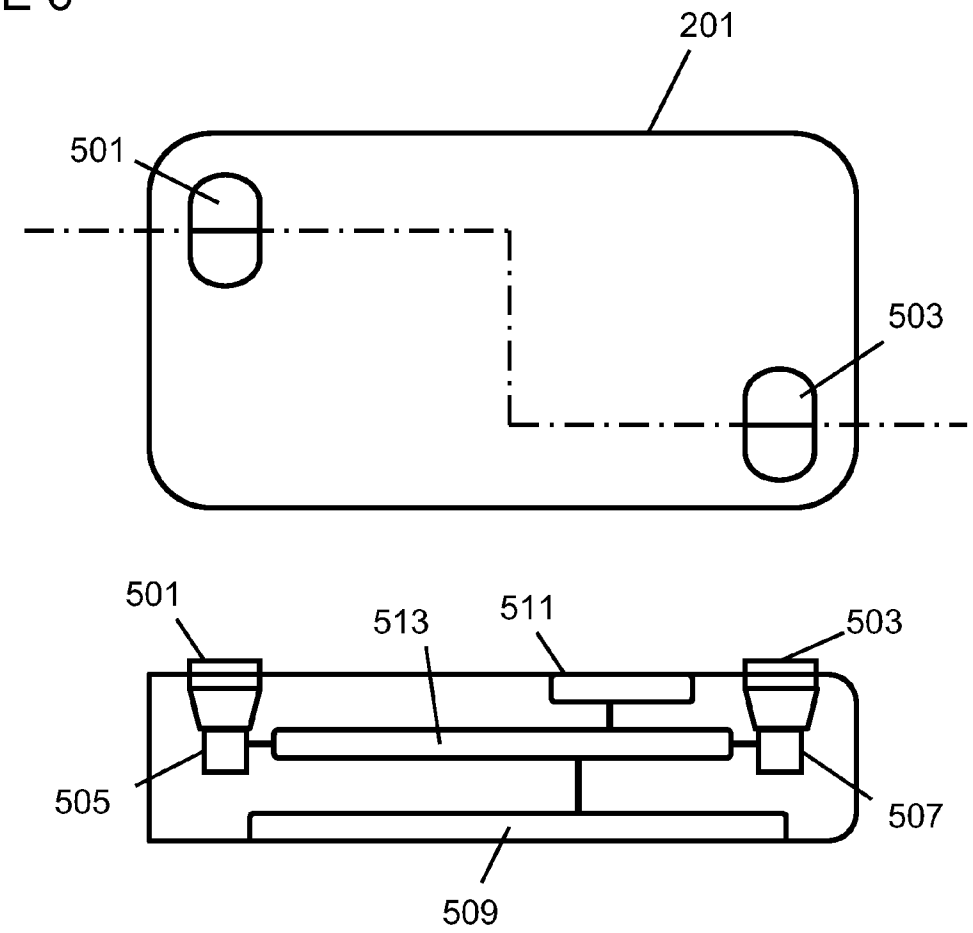
FIG. 6 discloses a schematic representation of a suitable portable device according to some embodiments.

FIG. 6 discloses a schematic representation of a portable device suitable for coupling to apparatus according to some embodiments of the application.

It would be understood that stereo speaker representation is generally preferred by users over mono speaker representation of audio signals. However the separation of the speakers of portable or mobile devices are generally limited by the device in question and cannot be placed suitably far apart to produce a suitable stereo speaker separation because of the physical size limitation of the device in question. An example of such a portable device is shown herein. The portable device 201 can, for example, comprise two acoustic windows for allowing the outputs from separate channel speaker transducers and generating a stereo sound output.

The example shown in FIG. 6 shows a first speaker acoustic window 501 and a second acoustic window 503 which can be associated with a first "left" channel audio signal and a second or "right" channel audio signal respectively. As can be seen in FIG. 6 the acoustic windows can in some embodiments be located at the diagonally opposite corners of the device 201 to provide a maximum separation distance but yet would have a typically poor stereo separation because of the short distance between the sound outlets due to the physical size of the portable device.

As can be seen in FIG. 6, in some embodiments the sound outlets or acoustic windows can be raised relative to the surface profile of the portable device 201. However it would be understood that in some other embodiments the sound outlets can be in line with, flush with, or recessed with respect to the surface profile of the portable device 201.

Furthermore in some embodiments each of the acoustic windows are coupled via an associated acoustic chamber internal to the portable device to an associated acoustic transducer also internal to the device. Thus, for example, the first acoustic window 501 can be coupled via a first internal acoustic chamber to a first acoustic transducer 505 and the second acoustic window 503 can be coupled to a second acoustic transducer 507 via a second internal acoustic chamber.

Furthermore in some embodiments the device comprises at least two acoustic transducers configured to generate the acoustic waves for the left and right (or first and second) audio channels. The acoustic transducers can be configured in some embodiments to receive audio signals to power the acoustic transducers from a printed circuit board (PCB) or printed wire board (PWB) 513 internal to the casing of the device. The printed wire board/printed circuit board can be configured in some embodiments to physically support and/or electrically couple components of the portable device such as a processor, memory, transceiver, and sound generating module. The printed wire board or printed circuit board can furthermore in some embodiments be connected or coupled to a display 509 and/or user interface and furthermore in some embodiments coupled to an antenna 511 for transmitting or receiving wireless signals.

The first and second acoustic transducers 505 and 507 as shown in FIG. 6 can be implemented as in some embodiments as an integrated speaker such as an integrated handsfree speaker (IHS). The acoustic transducers can be implemented as any suitable transducer such as a dynamic or moving coil configuration, a piezoelectric transducer, an electrostatic transducer or a transducer array comprising microelectromechanical systems (MEMS). Additionally or alternatively in some embodiments the acoustic transducer can be implements as part of a multifunction device (MFD) component, the MFD being any of the following: combined earpiece, integrated handsfree speaker, vibration generation means, or a combination thereof.

The portable device 201 can be a mobile phone, portable audio device, user equipment or any other means for playing sound. For example, the portable device in some embodiments can be a mobile terminal, mobile phone or user equipment for operation in a wireless communication system. In other embodiments, the portable device is any suitable electronic device configured to generate sound, such as, for example, a digital camera, a portable audio player (also known as MP3players), a portable media or video player (also known as MP4 players). In some other embodiments the apparatus may be any suitable electronic device with a pair of speakers configured to generate sound.

In some embodiments the acoustic chamber is a horn shaped structure comprising a throat portion which widens to a mouth portion. The horn shaped structure is in such embodiments coupled to the acoustic actuator at the throat portion and coupled to the acoustic window 501 at the mouth portion of the horn shaped structure. The horn shaped structure can be any of the following, a conical horn, an exponential horn, a tractrix horn or the horn shaped structure may comprise in some embodiments some characteristics of these types of horn. In other words, the horn shaped structure or acoustic chamber can be substantially horn shaped but can be an imperfect form.

The throat portion of the horn shaped structure can be configured to have a small cross sectional area and the horn shaped structure flares to the mouth portion having a larger cross sectional area than the throat. The flaring of the horn shaped structure is configured such that the sound waves decompress and increase the displacement of the air at the mouth portion compared to the throat portion. The horn shaped structure therefore in such embodiments provides improved acoustic impedance matching between the integrated speaker or transducer and the air external to the device. In such a manner, amplification of the sound from the acoustic transducer at the external portion of the device is achieved with the horn shaped structure.

Figure 1:
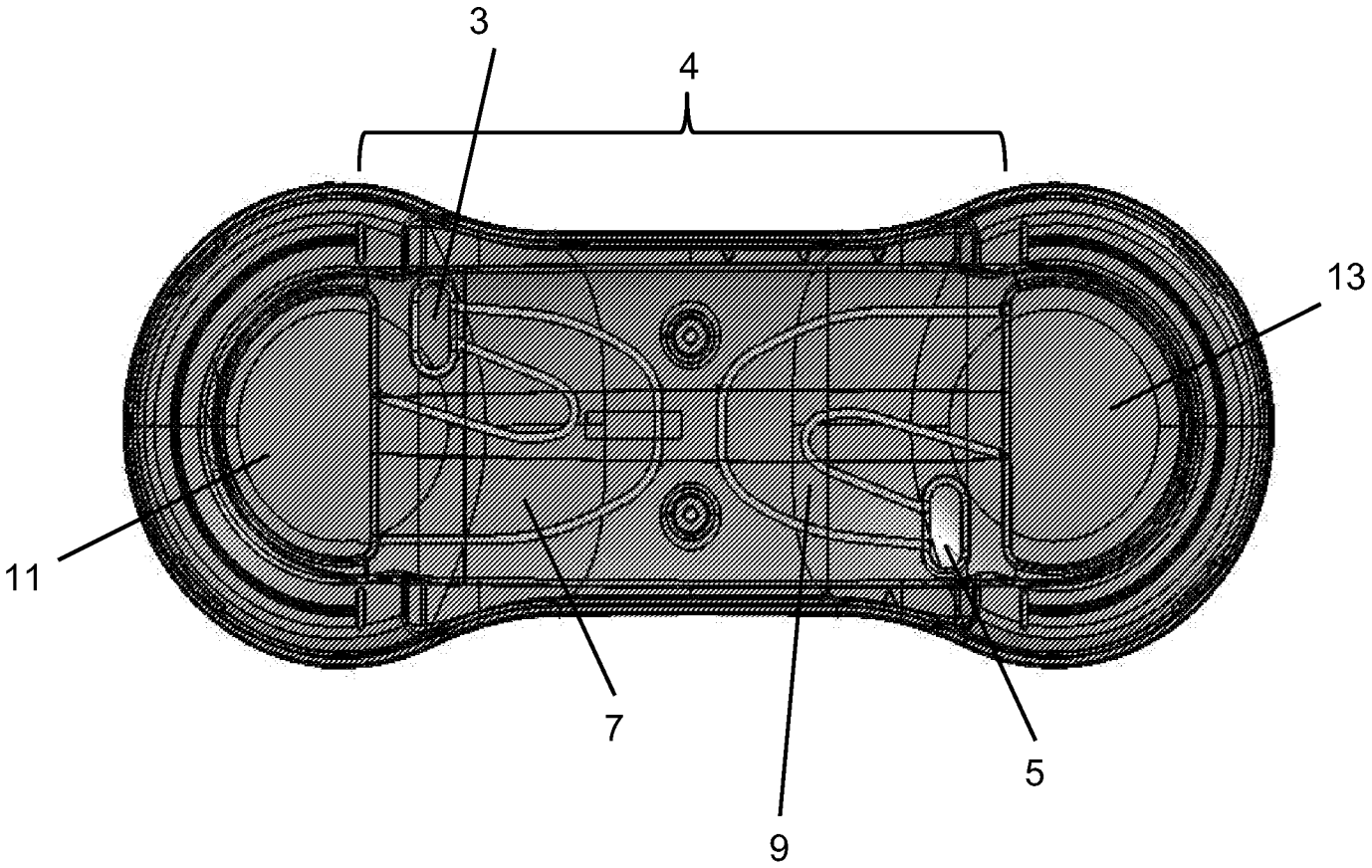
FIG. 1 illustrates a schematic representation of an apparatus suitable for providing stereo passive amplification according to some embodiments.

With respect to FIG. 1, an example of the apparatus according to some embodiments of the application is shown. The concept behind the apparatus as shown is to improve the stereo separation when compared to the portable speaker dimensions device and further provide additional passive amplification assistance. In such a way, sound can be amplified and the separation distance between the two speakers is widened allowing a much better sound stereo quality than the original sound from the device speakers.

The apparatus 1 comprises a casing within which there is provided a first acoustic hole 3 and a second acoustic hole 5. The casing of the apparatus can be constructed from any suitable material, and formed using any suitable method of manufacture. For example the apparatus can be manufactured from one or more pieces of plastic. The casing 1 can for example be made from an opaque or transparent plastic material. The first acoustic hole 3 and the second acoustic hole 5 in some embodiments are configured such that they can couple physically and acoustically with the first acoustic window 501 and the second acoustic window 503 of the portable device respectively.

In some embodiments the apparatus acoustic hole 3 and 5 can further be configured to have sound sealing rings. The sound sealing rings in some embodiments can be formed by a soft material such as, for example, silicone rubber surrounding the acoustic hole. In some embodiments, the sound sealing ring can receive the acoustic window of the portable device and thus physically locate the portable device by the acoustic window structure within the acoustic hole. In some other embodiments the sound sealing rings can be configured to physically locate the device by coupling physically with the devices recessed acoustic windows. In some embodiments the sound sealing rings are detachable or located on the portable device and can be shaped to adapt the shape or profile of the acoustic windows of the portable device to fit the acoustic hole of the apparatus. Thus in some embodiments each of the first and second substantially horn shaped structure throat portions can have a cross sectional area which is greater than each of the first and second speaker acoustic outlet of the further apparatus cross sectional area and thus in such embodiments permit the substantially horn shaped structure to completely cover the portable device acoustic windows.

In some other embodiments each of the first and second substantially horn shaped structure throat portions can have a cross sectional area which is substantially the same as each of the first and second speaker acoustic outlet of the further apparatus cross sectional area to permit a close match and sealing of the portable device acoustic windows. In some further embodiments each of the first and second substantially horn shaped structure throat portions can have a cross sectional area which is less than each of the first and second speaker acoustic outlet of the further apparatus cross sectional area.

The sound sealing ring around the sound opening in the apparatus is configured to provide a seal between the speaker hole and the acoustic transducer acoustic window of the device to prevent sound leaking.

The apparatus 1 can furthermore in some embodiments comprise a holding section 4 or locating section. The holding section 4 can be a recess within the apparatus 1 which is configured to physically receive or couple detachably the portable device. In some embodiments a locating feature or features can be configured to assist the physical positioning of the portable device correctly with the apparatus. For example as described herein the apparatus acoustic holes 3 and 5 can be configured to receive the portable device acoustic windows 501 and 503 which sit proud from the device case. In some embodiments the locating section can comprise "lips" or flanges which releasably hold the portable device to prevent accidental displacement of the portable device from the apparatus when knocked or jogged. However in some embodiments any suitable locating mechanism can be used. Furthermore in some embodiments the locating mechanism can be configured to handle a range of different portable devices with differently shaped casings. For example in some embodiments the apparatus can be formed so that the locating means requires only a "standard" acoustic window pattern so to attach the portable device to the apparatus. In the examples shown herein, the acoustic window pattern is such that the speakers are configured at diagonally opposite corners of the device, however any suitable arrangement or configurations of speakers can be implemented. For example in some embodiments acoustic windows and thus apparatus acoustic hole pattern outputs can be at the same short side, long side, or at any suitable place on the casing as the physical separation of the stereo channels is improved by embodiments of the apparatus as described herein.

In some embodiments the apparatus comprises a pair of horn shaped sound channels. Each horn shaped sound channel is configured to be coupled to (at a first throat portion with a cross-section similar to the speaker hole cross-section) to the associated speaker hole and at the mouth portion to a sound opening or exit. For example as can be seen in FIG. 1, the first acoustic hole 3 (the right slanting cross-hatched area) is coupled to a first horn shaped sound channel 7 (shown by the left slanting cross-hatched area) and the first horn shaped channel 7 further coupled to a first sound opening 11. The second acoustic hole 5 is similarly coupled via the second horn-shaped sound channel 9 to the second sound opening 13.

The horn shaped sound channel can be formed by any suitable structure and can be configured to increase the loudness and/or the sensitivity of one or more of the frequencies across the frequency response of the playback system. In some embodiments the horn shaped sound channel can be configured to provide a filtering operation on the acoustic output, in other words the frequency response of the playback is not constant across the frequency range. For example, the length and shape of the horn shaped sound channel can in some embodiments be configured to provide a frequency roll-off such that very high frequencies and/or very low frequencies are filtered out. In other words the acoustic performance of the horn shaped region can act as an acoustic filter to advantageously tune the device output. Furthermore the horn shaped configuration can be any suitable configuration. As shown in FIG. 1, the horn shaped structure is configured to couple the apparatus speaker holes to the sound openings using a "U-shaped" horn.

In some embodiments the apparatus 1 further comprises a pair of sound openings or sound exits. The sound openings or sound exits are configured in some embodiments to direct the acoustic signal in a manner suitable to present a stereo effect for the user of the device. Furthermore in some embodiments the speaker or sound openings are configured to further provide a widening aperture coupling between the horn shaped sound channel and the environment in order to increase the loudness of the signal. As shown in FIG. 1, a first sound opening 11 is configured to be coupled to the mouth of the first horn shaped sound channel 7 and a second sound opening 13 is configured to be coupled to the mouth of the second horn shaped sound channel 9. The example shown in FIG. 1 directs the acoustic signal in an opposite direction to which the original acoustic signal enters the apparatus, in other words if the apparatus is considered to have a front face, it directs the acoustic signal in that direction and towards the user.

In some embodiments the apparatus can be configured to have a flat surface to allow the apparatus to stand unassisted. However it would be appreciated that any other type of configuration enabling the positioning of the apparatus could be employed such as a "stand" or lugs or fins on the apparatus which can be integrated with or attached to the apparatus.

Figure 2:
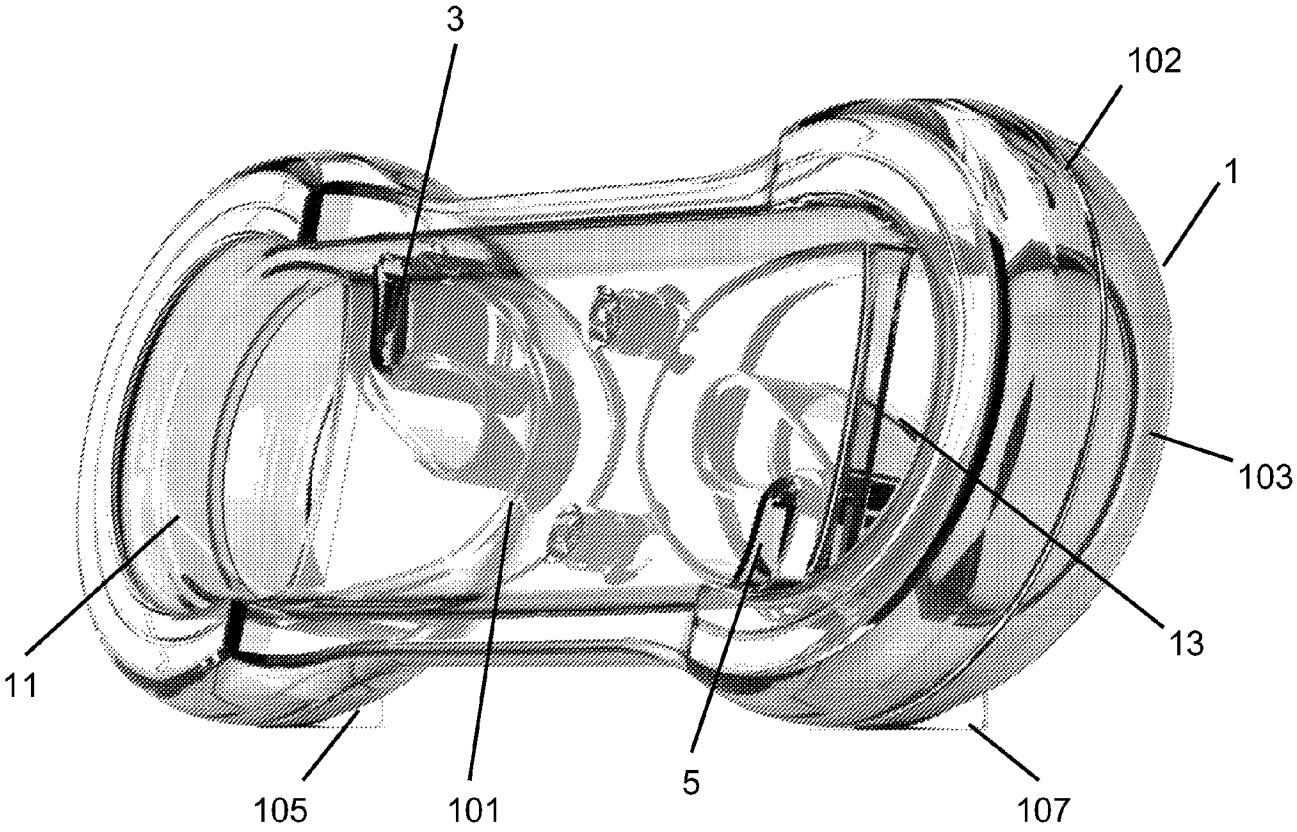
FIG. 2 discloses a perspective view of an apparatus according to some embodiments.

With respect to FIG. 2, a perspective view of the apparatus 1 according to some embodiments is shown. The apparatus as shown in FIG. 2 can be configured to be formed from a pair of plastic parts joined by an assembly coupling. The spacing between the front part 101 and the rear part 103 can in some embodiments to be configured to form the horn shaped sound channel in the void or gap between them. In some embodiments the front portion 101 can be configured with a holding or locating section which is associated with a particular portable device such that a range of devices can be used by the apparatus by changing the front portion relative to the rear portion. Furthermore the tuning of the horn shaped sound channel can thus be configured to differ dependent on the device placed or designed to be placed in association with the apparatus as the void structure can be changed or modified by the different combinations of front portion and rear portion.

As further can be seen in FIG. 2, the apparatus 1 comprises a pair of stands 105 and 107 configured to enable the apparatus 1 to "stand" unassisted on a flat surface in such a manner that the apparatus projects the acoustic wave substantially in a horizontal plane.

The join 102 between the front and rear portions can be seen also in FIG. 2. It would be appreciated that although this example shows a two-portion or piece construction of the apparatus, the apparatus could be machined or manufactured from a single piece or more than two pieces.

Figure 3:
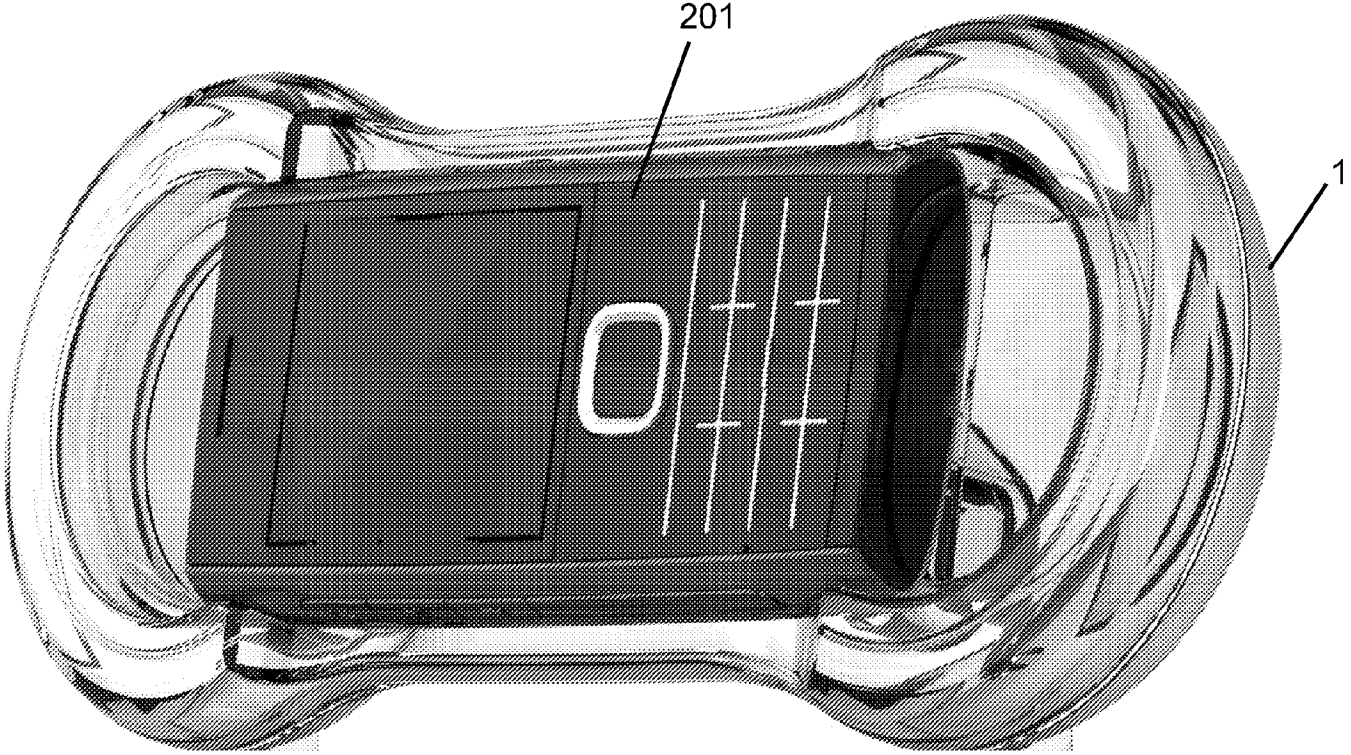
FIG. 3 discloses a perspective view of the apparatus shown in FIG. 1 when coupled to a portable device such as shown in FIG. 6 according to some embodiments.

With respect to FIG. 3, the apparatus is shown wherein the portable device is located within "at least partially" the apparatus 1 such that the display of the portable device 201 can be seen and thus present information on the music or sound being generated and output by the apparatus 1. It would be appreciated that with the speaker/acoustic window arrangement shown in FIGS. 1 and 2 and the device shown in FIG. 6 that the apparatus can be configured to receive the device in two separate ways with a rotational symmetry of 180°.

Figure 4:
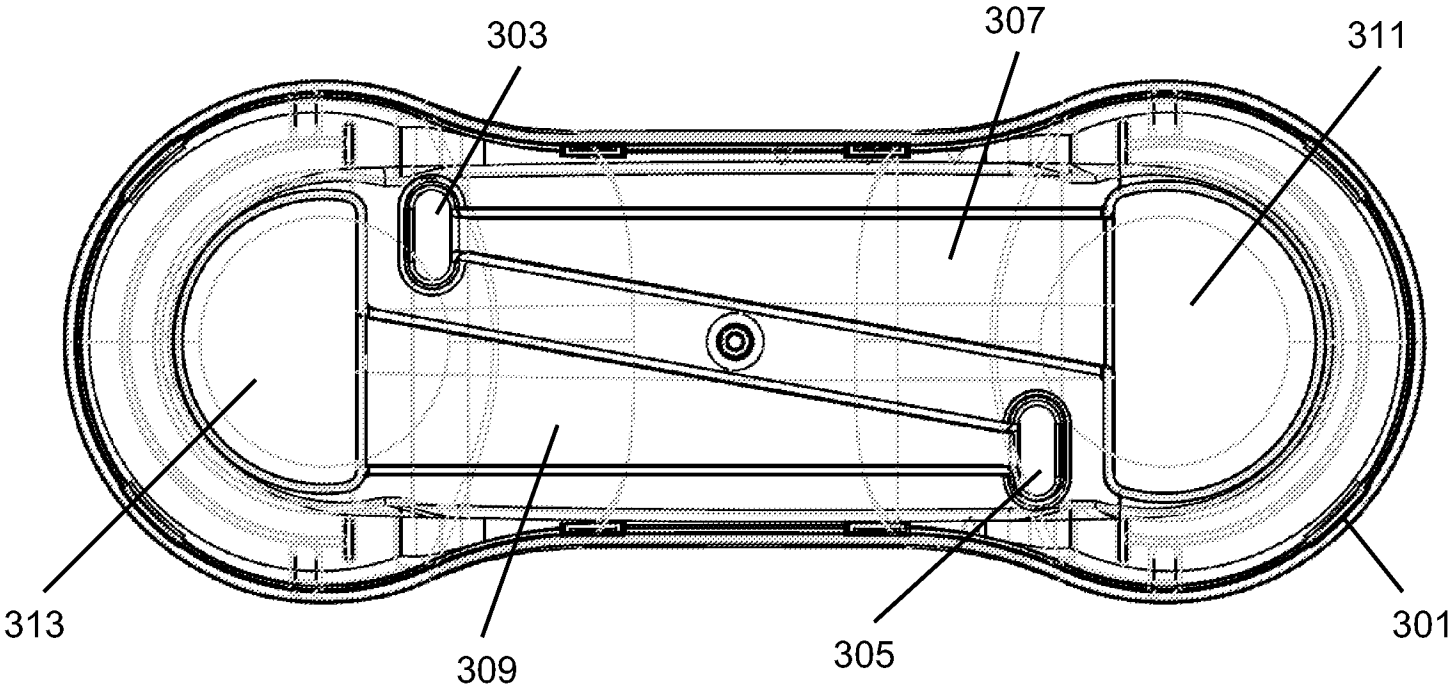
FIG. 4 discloses a schematic representation of further apparatus suitable for providing stereo passive amplification according to some embodiments.

With respect to FIG. 4, a further example of the apparatus is shown. The further example of the apparatus 301 shows a similar speaker hole arrangement as shown in FIG. 1 with a first acoustic hole 303 and a second acoustic hole 305. However the first horn shaped sound channel 307 which couples the first acoustic hole on one side of the apparatus to the sound opening on the opposite side of the apparatus. Thus the further example first horn shaped sound channel 307 is configured with a throat portion coupling the first acoustic hole 303 to the second sound opening 311 via the mouth portion of the horn shaped sound channel and similarly the second horn shaped sound channel is configured to couple at the throat region to the second speaker hole and at the mouth portion to the first sound opening at the opposite side to the second acoustic hole 305. It would be understood that in such an example, the device or apparatus can be rotated 180° with respect to each other and maintain the sound stereo direction unchanged.

It would be understood that in some embodiments the user equipment or device can be configured to detect or determine when it is in association with or coupled to the apparatus. For example in some embodiments the apparatus can be configured to comprise a radio frequency identification unit (also known as RFID) which can be detected by the portable device, for example via the antenna 511 causing the sound generation module of the portable device 201 to be configured to tune the acoustic output such that the acoustic tuning produced by the apparatus and the digital signal processing by the portable device can produce an advantageous acoustic output. Furthermore in some embodiments the apparatus or sound booster can be detected by the device, for example by any suitable detection or determining means or sensor such as a camera, and/or micro-switch, and/or light sensor.

In some embodiments the portable device 1 comprises such a sensor (not shown) configured to detect that the portable device 1 is being used with the apparatus. The sensor can as described herein comprise a photometer or other type of light sensor configured to detect the ambient light levels. In this way, a processor of the portable device is configured to receive a signal from the sensor when the ambient light level has decreased and to receive a signal that the portable device is coupled to the apparatus for generating sound.

In some embodiments there may additionally or alternatively be an accelerometer or other sensors for detecting whether the portable device is positioned at a specific position orientation in the apparatus. On detection of the specific position or orientation of the portable device in the apparatus, one or more sensors can be configured in some embodiments to send a signal indicating position and/or orientation information to the processor of the portable device. The processor can then be configured to determine the position and/or orientation of the portable device from the received signal and adjust digital signal processing accordingly.

In other embodiments there may additionally or alternatively be a sensor monitoring the sound pressure level around the outlet of the speaker of the portable device. The sensor may detect changes to the sound pressure level when the device is coupled with the apparatus as the acoustic impedance changes when the portable device is coupled to the apparatus. The pressure sensor can in some embodiments be configured to send a signal to the processor. The pressure sensor signal in some embodiments can comprise an indication of a change in the sound pressure level around the outlet of the speaker. The processor of the portable device in such embodiments can be configured to determine that the portable device is coupled to the apparatus from the received signal and adjust the digital signal processing accordingly. For example in some embodiments the sound pressure level around the outlet of the speaker of the portable device can be monitored by determining the electrical impedance of the speakers. The electrical impedance of each speaker is dependent on the acoustic loading experienced by the speaker and thus would differ between when the speaker is operating in free air to when the speaker is interfaced with the apparatus. In some embodiments therefore a calibration operation can be performed by the portable device whereby an acoustic output is generated and the electrical impedance of the portable device speakers is measured. The results of which in some embodiments can be processed by the processor of the portable device to determine whether the portable device is interfaced with the apparatus and furthermore in some further embodiments to modify the digital signal processing parameters applied to the output audio signals such that a desired loudness and/or frequency response can be generated using the speakers.

In some embodiments the portable device microphone is configured to monitor the portable device output. For example the portable device can be configured to monitor the microphone whenever a media track, for example a music file, is output for a defined number of seconds. The portable device microphone signal can then be analysed to determine whether the apparatus and portable device are coupled or interfaced, and if the apparatus and portable device are interfaced then the portable device can configure or update the audio digital signal processing parameters to take into account that the acoustic output is being boosted by the apparatus.

The processor of the portable device can thus in some embodiments determine on the basis of information received from one or more sensors that the portable device is being used with the apparatus comprising the stereo horn type structure. Furthermore, the portable device can in some embodiments be configured to receive user input to specify that the portable device is being used with the apparatus. After the processor determines that the device 1 is acoustically coupled to the apparatus, the portable device processor can be configured to control the sound output of the portable device 1 accordingly. In some embodiments, the processor may be configured to tune the play back of sound for loudness. In this way loudness may be increased further on determination of the portable device being used with the apparatus comprising a horn type structure. Additionally or alternatively, the processor may be configured to modify the sound for quality and better sound performance. For example, the processor is configured to modify sound generation to tune the sound according to the frequency response of the apparatus. In some embodiments, the processor is configured to determine the type of horn structure acoustically coupled to the portable device and configure the sound generation dependent on the type of horn structure.

In some embodiments the portable device can comprise a port or socket configured to receive a plug or pin associated with the apparatus. In such embodiments the coupling of the plug or pin within the port or socket enables to the portable device to detect the presence of the apparatus. Furthermore in some embodiments the detection of the pin or plug and/or the shape of the pin or plug can be configured to identify the apparatus sound booster and/or the type of booster and so enable the portable device to configure the audio output with a suitable volume level and/or frequency response.

In some embodiments the pin or plug of the apparatus can be configured to press a button or more than one button on the portable device to indicate to the portable device that it is in contact with the apparatus and/or the type of apparatus being used.

In some embodiments the pins or plug can be detected by a touch or pressure sensitive region on the portable device (for example a touch screen display or touch interface), the pattern or positioning of the detected pins or plug being used by the portable device to indicate the presence and/or type of apparatus being used.

In some embodiments of the application the detection of the apparatus by the portable device can be a manual or user input selection. For example the portable device can be configured to modify the audio output parameters when the apparatus is interfaced with the portable device by selection of an input on a program or application of the portable device. Similarly the input on a program or application of the portable device can in some embodiments selected manually when the apparatus is removed from the portable device.

In some embodiments the portable device processor can be configured to perform an automatic loudness adjustment with respect to the audio signal output dependent on the detection of the apparatus. For example in some embodiments the portable device processor could control the loudness or volume of the portable device when detecting the apparatus is present and interfaced with the portable device in order to save energy or battery power.

Figure 5:
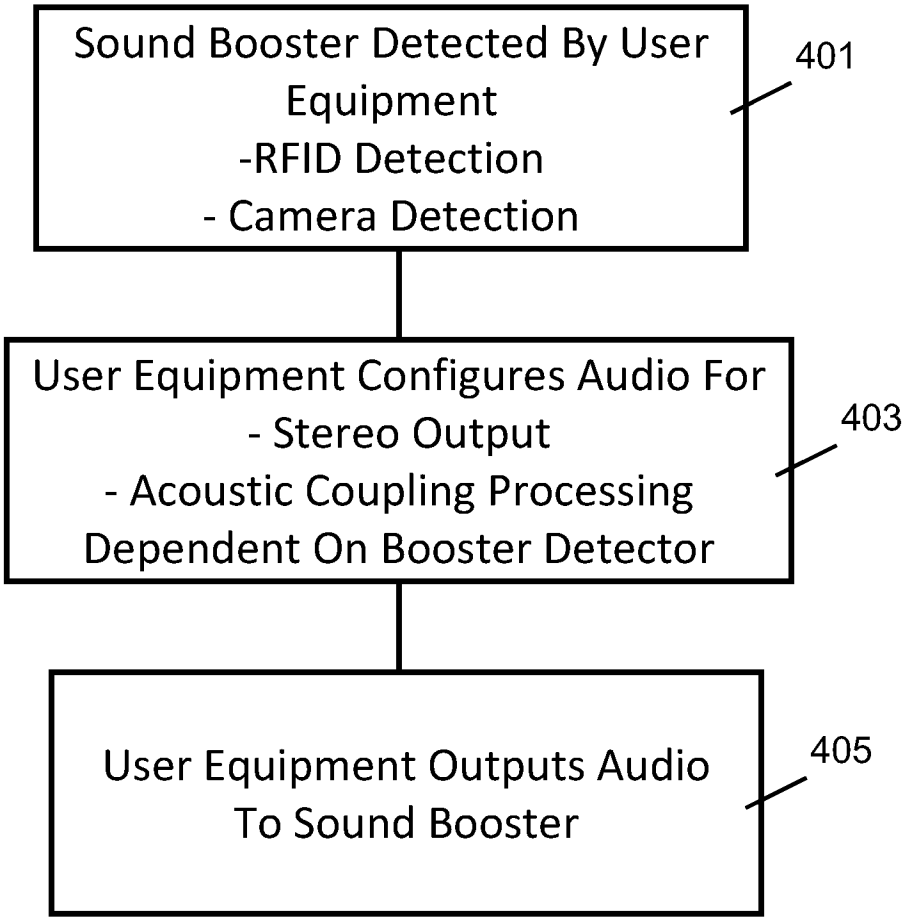
FIG. 5 discloses a flow diagram of the operation of active determination by the apparatus of a coupling with a portable device according to some embodiments of the application.

With respect to FIG. 5, the operation of the detection by the portable device and/or user equipment of the apparatus is shown in the figure by step 401.

Furthermore the operation of the portable device configuring the audio for stereo output or acoustic coupling processing dependent on the booster detection is shown in FIG. 5 by step 403.

Thus when the portable device is configured to output audio, it can in some embodiments output audio suitably tuned for the apparatus.

In some embodiments portable device can be configured to detect or determine the type of the apparatus, for example the portable device can be configured to determine whether the output audio channels should be maintained, for example when detecting apparatus such as shown in FIG. 1, or reversed for example when detecting apparatus such as shown in FIG. 4.

In general, the various embodiments may be implemented in hardware or special purpose circuits, software, logic or any combination thereof. Some aspects of the invention may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware.

For example, in some embodiments the method of manufacturing the apparatus may be implemented with processor executing a computer program.

Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules.

Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

What is claimed is:

1. An apparatus comprising:

a casing;

a first substantially horn shaped structure located within the casing and configured to couple and amplify sound from a first speaker of a further apparatus configured to be coupled to the casing; and a second substantially horn shaped structure located within the casing and configured to couple and .amplify sound from a second speaker of the further apparatus, wherein the first substantially horn shaped structure and the second substantially horn shaped structure each comprise a mouth portion with a physical separation dimension greater than a physical separation dimension of a first speaker outlet and a second speaker outlet of the further apparatus;

a detector on the further apparatus, the detector configured to determine the first speaker and the second speaker of the further apparatus are coupled to the first substantially horn shaped structure and the second substantially horn shaped structure, respectively, on the apparatus;

a digital signal processor on the further apparatus, the digital signal processor configured to output an audio signal to the first speaker and to the second speaker dependent on the detector, the digital signal processor being configured to modify at least one of a frequency response and a loudness of the audio signal dependent on the detector; and an indicator on the apparatus and configured to be detected by the further apparatus such that the audio signal can be tuned based on the digital signal processor when the indicator is detected;

wherein the further apparatus is a portable apparatus comprising at least the first speaker and the second speaker; and wherein the sound from the first speaker and the second speaker is amplified through the first substantially horn shaped structure and the second substantially horn shaped structure, respectively, and wherein stereo sound quality from the first speaker and the second speaker is improved due to a widening of a separation distance between the first speaker and the second speaker due to the first substantially horn shaped structure and the second substantially horn shaped structure.

2. The apparatus as claimed in claim 1, wherein a mouth portion of each of the first substantially horn shaped structure and the second substantially horn shaped structure has a cross sectional area greater than each of the first speaker outlet and the second speaker outlet of the further apparatus cross sectional area.

3. The apparatus as claimed in claim 2, wherein the mouth portion of each of the first substantially horn shaped structure and the second substantially horn shaped structure has a throat portion that flares to the mouth portion, the throat portion having a smaller cross sectional area than the mouth portion, the throat portion having a cross sectional area which is one of:

greater than each of the first speaker outlet and the second speaker outlet of the further apparatus cross sectional area;

substantially the same as each of the first speaker outlet and the second speaker outlet of the further apparatus cross sectional area; and less than each of the first speaker outlet and the second speaker outlet of the further apparatus cross sectional area.

4. The apparatus according to claim 1, wherein each substantially horn shaped structure comprises at least one of:

a conical horn;

an exponential horn; and a tractrix horn.

5. The apparatus as claimed in claim 1, wherein each substantially horn shaped structure is acting as an acoustic filter to tune the sound according to the frequency response of the further apparatus.

6. The apparatus as claimed in claim 1, further comprising:

a first interface portion configured to seal a throat portion of the first substantially horn shaped structure to the first speaker outlet; and a second interface portion configured to seal a throat portion of the second substantially horn shaped structure to the second speaker outlet.

7. The apparatus as claimed in claim 6, wherein each of the first interface portion and the second interface portion can further releaseably mechanically couple the further apparatus to the apparatus.

8. The apparatus as claimed in claim 1, further comprising a locating portion configured to releaseably mechanically couple the further apparatus to the apparatus.

9. The apparatus as claimed in claim 1, further comprising:

a first part comprising at least two audio input windows; and a second part comprising at least two audio output windows, wherein the first part and the second part form a structure with two separate voids, the first void forming the first substantially horn shaped structure located between the first part first audio input window and the second part first audio output window and the second void forming the second substantially horn shaped structure defined between the first part second audio input window and the second part second audio output window.

10. The apparatus as claimed in claim 1, wherein the indicator comprises at least one of:

a plug configured to interface with the further apparatus;

at least one pin configured to interface with the further apparatus;

a cover configured to interface with the further apparatus; and wherein the indicator is configured to identify the apparatus to the further apparatus.

11. The apparatus as claimed in claim 1, wherein the first substantially horn shaped structure is dimensionally different from the second substantially horn shaped structure.

12. A portable apparatus comprising:

a passive amplifier comprising a first substantially horn shaped structure and a second substantially horn shaped structure; and an apparatus coupled to the passive amplifier, the apparatus comprising, a first speaker;

a second speaker;

a detector on the apparatus and configured to determine the first speaker and the second speaker are coupled to the first substantially horn shaped structure and the second substantially horn shaped structure, respectively, of the passive amplifier; and a digital signal processor on the apparatus and configured to output an audio signal to each speaker dependent on the detector, the digital signal processor being configured to modify at least one of a frequency response and a loudness of the audio signal dependent on the detector; and an identifier on the apparatus and in communication with the digital signal processor and configured such that the audio signal can be tuned;

wherein the sound from the first speaker and the second speaker is amplified, and wherein stereo sound quality from the first speaker and the second speaker is improved due to a widening of a separation distance between the first speaker and the second speaker.

13. The portable apparatus as claimed in claim 12, wherein the detector comprises at least one of:

a light sensor configured to detect a cover on the portable apparatus;

a radio frequency identifier sensor configured to detect a radio frequency identifier on the portable apparatus;

a socket configured to receive a plug or pin on the portable apparatus;

a keypad configured to receive a plug or pin on the portable apparatus;

at least one microswitch configured to receive a plug or at least one pin on the portable apparatus; and an electrical impedance monitor coupled to each speaker.

14. The portable apparatus as claimed in claim 12, wherein the digital signal processor comprises a first speaker digital signal processor configured to output an audio signal to the first speaker dependent on the detector; and a second speaker digital signal processor configured to output a further audio signal to the second speaker dependent on the detector.

15. The portable apparatus as claimed in claim 12, wherein the detector is configured to determine dimensionally different horn shaped structures and control the digital signal processor to account for a difference between the dimensionally different horn shaped structures.

16. The portable apparatus as claimed in claim 12, wherein the digital signal processor comprises at least one of:

an equalizer;

an amplifier with variable gain;

a volume level controller;

a dynamic range controller;

a bandwidth controller;

a filter with a defined frequency response;

a speaker/transducer protection controller; and a loudness controller.

17. The portable apparatus as claimed in claim 12, wherein the detector is configured to detect the type of portable apparatus.

18. The portable apparatus as claimed in claim 12, wherein the detector is a user input to the apparatus.

* * * * *